US011473320B2

(12) United States Patent
Schneider et al.

(10) Patent No.: US 11,473,320 B2
(45) Date of Patent: Oct. 18, 2022

(54) COMPENSATING CEILING FORMWORK ELEMENT FOR BUILDING AROUND AN OBSTACLE

(71) Applicant: Peri GmbH, Weissenhorn (DE)

(72) Inventors: Werner Schneider, Erbach (DE); Eugen Belmann, Weissenhorn (DE)

(73) Assignee: Peri SE, Weissenhorn (DE)

( * ) Notice: Subject to any disclaimer, the term of this patent is extended or adjusted under 35 U.S.C. 154(b) by 0 days.

(21) Appl. No.: 16/316,030

(22) PCT Filed: Jul. 5, 2017

(86) PCT No.: PCT/EP2017/066710
§ 371 (c)(1),
(2) Date: Jan. 7, 2019

(87) PCT Pub. No.: WO2018/007420
PCT Pub. Date: Jan. 11, 2018

(65) Prior Publication Data

US 2019/0161982 A1 May 30, 2019

(30) Foreign Application Priority Data

Jul. 6, 2016 (DE) ..... 10 2016 212 282.7

(51) Int. Cl.
*E04G 11/38* (2006.01)
*E04G 9/02* (2006.01)
(Continued)

(52) U.S. Cl.
CPC ..... *E04G 11/38* (2013.01); *E04G 9/02* (2013.01); *E04G 11/36* (2013.01); *E04G 11/48* (2013.01); *E04G 11/483* (2013.01)

(58) Field of Classification Search
CPC ..... E04G 11/38; E04G 11/48; E04G 11/483; E04G 11/50; E04G 11/52; E04G 9/02
(Continued)

(56) References Cited

U.S. PATENT DOCUMENTS 1,471,159 A * 10/1923 Howie ..... E06B 3/984 52/690
1,477,190 A * 12/1923 Shore ..... E04G 11/48 249/18
(Continued)

FOREIGN PATENT DOCUMENTS

CN 202731285 2/2013
CN 204059954 * 12/2014 ..... E04G 11/48
(Continued)

OTHER PUBLICATIONS

Translation of FR 3,003,285. (Year: 2014).*

*Primary Examiner* — Michael Safavi
(74) *Attorney, Agent, or Firm* — Wei & Sleman LLP

(57) ABSTRACT

A formwork element of a ceiling formwork. The formwork element has a non-fully circumferentially closed, in particular U-shaped, frame onto which a formwork skin can be or is arranged. The frame preferably has at least a first leg, a second leg and a base strut in between. The base strut is preferably oriented at a right angle ±5° relative to the two legs. The legs are preferably each provided at their end regions opposite to the base strut with a fastening projection and/or a fastening recess. The formwork element can be suspended by a worker from below into a pillar head and is upwardly pivotable. It makes it possible to build around an obstacle in a simple manner while maintaining a grid-like imprint structure in the concrete surface to be created with the ceiling formwork.

15 Claims, 7 Drawing Sheets

Figure 1:
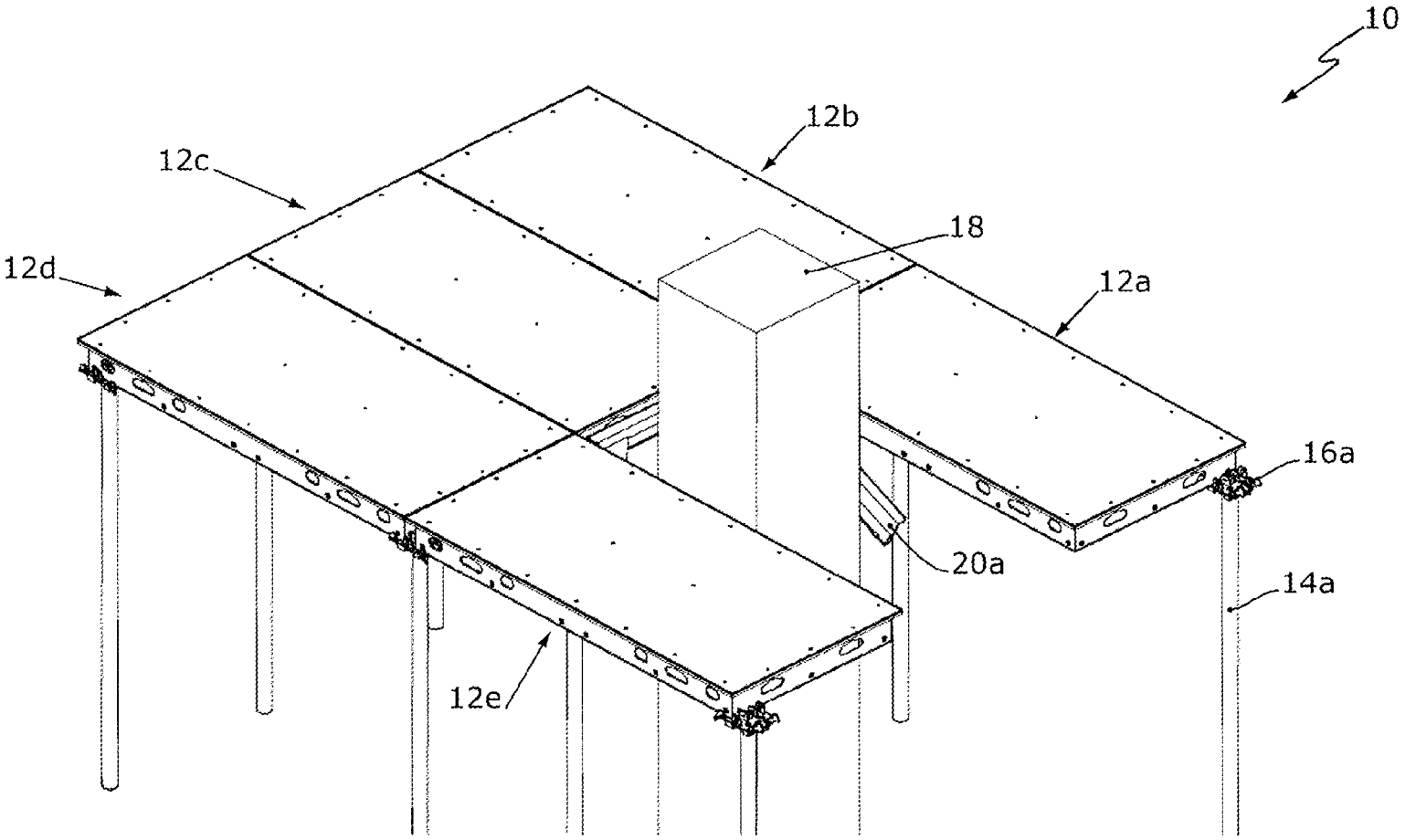

(51) Int. Cl.
*E04G 11/36* (2006.01)
*E04G 11/48* (2006.01)

(58) Field of Classification Search
USPC .. 52/657, 656.1, 656.2, 656.5, 656.6, 656.7; 160/351; 40/606.7, 611.06, 606.17; 29/897.15, 897.312
See application file for complete search history.

(56) References Cited

U.S. PATENT DOCUMENTS 1,893,636 A * 1/1933 Ridgway ..... E04B 1/2403 52/272
1,942,093 A * 1/1934 Goldsmith ..... E04G 11/48 249/29
2,029,434 A * 2/1936 Mitchell ..... A47B 3/12 52/782.21
2,049,925 A * 8/1936 Rafter ..... E04C 2/384 52/657
2,101,349 A * 12/1937 Sharp ..... E06B 3/9682 403/280
2,170,564 A * 8/1939 Lundin ..... E04G 9/02 249/19
2,291,726 A * 8/1942 Kaufmann ..... E06B 9/52 52/204.597
2,675,895 A * 4/1954 Loewenstein ..... E04B 1/24 52/236.3
2,703,159 A * 3/1955 Van Fleet ..... E06B 3/9682 52/656.5
2,767,814 A * 10/1956 Johnson ..... E06B 7/2309 52/204.599
2,816,632 A * 12/1957 Nardulli ..... E06B 3/9688 52/656.7
3,397,858 A * 8/1968 Williams ..... E04G 11/50 249/18
3,479,070 A * 11/1969 Marateck ..... F16B 5/00 52/285.2
3,784,151 A * 1/1974 Steele ..... E04G 11/486 249/18
4,698,863 A * 10/1987 Mis ..... A47C 23/043 403/205
5,331,786 A * 7/1994 Lippert ..... E04C 3/38 403/205
7,640,871 B2 * 1/2010 Arozena Bergaretxe ..... E04G 11/38 108/150
7,707,795 B2 * 5/2010 Yu ..... E04B 2/7422 52/657
8,308,126 B2 * 11/2012 Arocena Begareche ..... E04G 11/486 249/18
8,752,312 B2 * 6/2014 Vaz ..... B44D 3/185 38/102.1
10,501,948 B2 * 12/2019 Lizarazu Zaldua ..... E04G 11/38
2003/0012607 A1 * 1/2003 Coday ..... E04G 11/38 405/272
2009/0211134 A1 * 8/2009 Topcuoglu ..... G09F 15/0018 40/606.17
2009/0211195 A1 * 8/2009 Schwoerer ..... E04G 11/52 52/692
2018/0135316 A1 * 5/2018 Apostolopoulos ..... E04G 5/165
2018/0328053 A1 * 11/2018 Schneider ..... E04G 11/483
2018/0334816 A1 * 11/2018 Schneider ..... E04G 11/48
2021/0172182 A1 * 6/2021 Routh ..... E04G 11/50
2022/0145648 A1 * 5/2022 Baron ..... E04G 11/50

FOREIGN PATENT DOCUMENTS

DE 102007021159 * 11/2008 ..... E04G 11/48
DE 112012006057 12/2014
DE 102016205957 A1 * 10/2017 ..... E04G 21/3204
EP 1375781 B1 1/2004
FR 3003285 * 9/2014 ..... E04G 11/38
KR 200442878 Y1 * 12/2008 ..... E04G 9/02
KR 20110096205 A * 8/2011 ..... E04G 9/02
KR 20120095219 A * 8/2012 ..... E04G 9/02
WO WO00/19038 * 4/2000 ..... E04G 11/48

* cited by examiner

COMPENSATING CEILING FORMWORK ELEMENT FOR BUILDING AROUND AN OBSTACLE

The invention relates to a formwork element for closing a hole in a ceiling formwork having a plurality of standard formwork elements that have a closed frame, wherein the formwork element has a frame for supporting a formwork skin in a formwork skin layer. The invention further relates to a ceiling formwork with such a formwork element as well as a method for erecting a ceiling formwork.

It is known to use a ceiling formwork for creating a building structure made of cast-in-place concrete. The ceiling formwork is put together from a plurality of standard formwork elements. These standard formwork elements typically have a completely closed frame parallel to the formwork skin layer. Because of their flexibility, standard formwork elements in the shape of frame panel elements are preferably used.

The disadvantage of the known standard formwork elements is that, in the event of an obstacle in the ceiling formwork, for example in the form of a column, temporary constructions must be used to work around the obstacle.

The object of the present invention is therefore to develop a generic standard formwork element in such a way that working around an obstacle is significantly simplified. The object of the present invention is further to provide a ceiling formwork having such a formwork element as well as a method for erecting a ceiling formwork having such a formwork element.

The object according to the invention is achieved by a formwork element having the features of claim 1, as well as by a ceiling formwork having the features of claim 11 and a method according to claims 12 and 13. The dependent claims specify useful further developments.

The object according to the invention is thus achieved by a formwork element having a frame for supporting a formwork skin that can be mounted from below. The formwork skin can be arranged in a formwork skin layer, in particular after pivoting the frame upward. The frame is thus constructed open on at least one side parallel to this formwork skin layer. The frame of the formwork element may, for example, have an L-shaped design.

The formwork element according to the invention thereby increases the safety of the ceiling formwork because the frame of the formwork element may be mounted from below. If a worker steps on the formwork surface of the ceiling formwork, he can no longer fall in the region around the obstacle.

The frame can also be inserted into the ceiling formwork in a simple manner in the same way as the frame of the standard formwork elements. "Working around" an obstacle is thereby significantly simplified.

An additional advantage of the formwork element according to the invention is the uniform appearance of a building structure of cast-in-place concrete created with the ceiling formwork. This is because the surface of the erected building structure has a continuous frame grid because of the frame.

The frame can have two legs that run parallel to each other within ±5°. The frame preferably has a U-shaped design, wherein two legs are connected via a base strut. The first leg, the second leg and/or the base strut can each be designed in the shape of a strut, specifically a strut with a profiled cross-section that extends in its longitudinal direction. The U shape of the frame makes it especially easy to build around an obstacle in a ceiling formwork.

For mounting the formwork element on two pillar heads, the formwork element preferably has a) a first fastening recess and/or a first fastening projection and/or b) a second fastening recess and/or a second fastening projection. The described fastening means are preferably each formed on legs of the frame of the formwork element.

For stabilizing the frame, this can have a first connecting strut and/or a second connecting strut. The first connecting strut can in particular be arranged or formed between a first leg, in particular of the U shape, and the base strut. The second connecting strut can in particular be arranged or formed between the second leg, in particular of the U shape, and the base strut. The connecting strut(s) allow for a significant stiffening of the frame without significantly limiting its leeway for receiving an obstacle.

The formwork element can have one or more transverse struts between the legs, in particular the legs of the U shape, in order to further stabilize the frame. In addition to this, the transverse strut(s) can be designed as additional support for the formwork skin. The transverse strut(s) further represent a reliable fall-protection device.

In order to be able to easily fasten the formwork skin to the frame, the frame preferably has a step for receiving the formwork skin. The step is preferably formed on the two legs as well as on the base strut of the U shape. More preferably, the step is designed to be continuous from the end of the first leg opposite to the base strut to the end of the second leg opposite to the base strut.

A particularly stable formwork element is achieved if its frame is formed by a metal profile. More preferably, the transverse strut or plurality of transverse struts, in particular all transverse struts, are made of metal.

The handling of the formwork elements, in particular overhead, is further simplified if the metal profile is designed in the form of an aluminum profile.

The formwork element preferably has a formwork skin, wherein the formwork skin is arranged on the frame. The formwork skin is preferably arranged on the frame only after the pivoting of the frame.

The object according to the invention is further achieved by a ceiling formwork having a previously described frame element. The ceiling formwork further has a plurality of standard formwork elements, each having a closed frame and a formwork skin. The frame of the standard formwork elements is preferably rectangular in shape. The formwork element according to the invention in this case serves as a compensating element between the standard formwork elements.

The legs of the formwork elements can be longer or shorter than the corresponding legs of the standard formwork elements. The legs of the formwork element are preferably half as long as the legs of at least one standard formwork element. Alternatively, the legs of the formwork element can be of equal length to the legs of at least one standard formwork element.

In addition, the ceiling formwork can have a plurality of formwork elements according to the invention.

The ceiling formwork has at least one pillar with a pillar head, onto which the formwork element is placed. The pillar head is preferably designed to support the frame of the formwork element in the region of the corner between a leg, in particular of the U shape and the base strut. More preferably, the pillar head is designed to support the frame only in the region of a leg.

The object according to the invention is further achieved by a method for erecting a ceiling formwork having a plurality of pillars, wherein a hole remains between an obstacle and the pillars into which a standard formwork element cannot be fitted, wherein a first formwork element is arranged in the hole from below so that a worker on the ceiling formwork on the first formwork element cannot fall completely through the hole. In contrast to known ceiling formworks, in which holes are closed from above, safety is significantly increased by the method according to the invention.

The object according to the invention is further achieved by a method for erecting such a ceiling formwork, wherein the method has the following method steps:

A) erection of a first pillar having a first pillar head and a second pillar having a second pillar head;

B) laying of a previously described first formwork element in the region of a base strut, in particular of the corner, of the frame on the first pillar head and the second pillar head, C) erection of a third pillar having a third pillar head and the underlaying of a first leg with the third pillar head;

D) erection of a fourth pillar with a fourth pillar head and underlaying of the second leg with the fourth pillar head.

The method according to the invention preferably further comprises the following method steps:

E) laying of a previously described second formwork element, wherein a first leg of the second formwork element is laid on the fourth pillar head and a second leg of the frame of the second formwork element is laid on the third pillar head;

F) erection of a fifth pillar having a fifth pillar head and a sixth pillar having a sixth pillar head, wherein the fifth pillar head and the sixth pillar head underlay the second formwork element in the region of a base strut of the frame of the second formwork element.

An additional method step or additional method steps can be performed before, after or between the aforementioned method steps.

In particular, one or a plurality of transverse strut(s) can be mounted in the frame of the first formwork element before or after method step A). Alternatively or additionally, one or a plurality of transverse strut(s) can be mounted in the frame of the second formwork element before or after method step E). One or a plurality of transverse struts can be mounted in the frame from below.

Moreover, in a method step G), a formwork skin can be applied to the first formwork element and/or the second formwork element, in particular after the method step F).

The method according to the invention allows the erection of a ceiling formwork in a very simple manner, in particular if an obstacle is "enclosed" by two formwork elements according to the invention.

Further features and advantages of the invention are presented in the following detailed description of an exemplary embodiment of the invention, in the claims and in reference to the figures of the drawing, which show details that are essential to the invention. The various features can each be realized in variants of the invention individually or by any combination of multiple features. The features shown in the drawing are depicted in such a way that the special features according to the invention can be made clearly visible.

Figure 2:
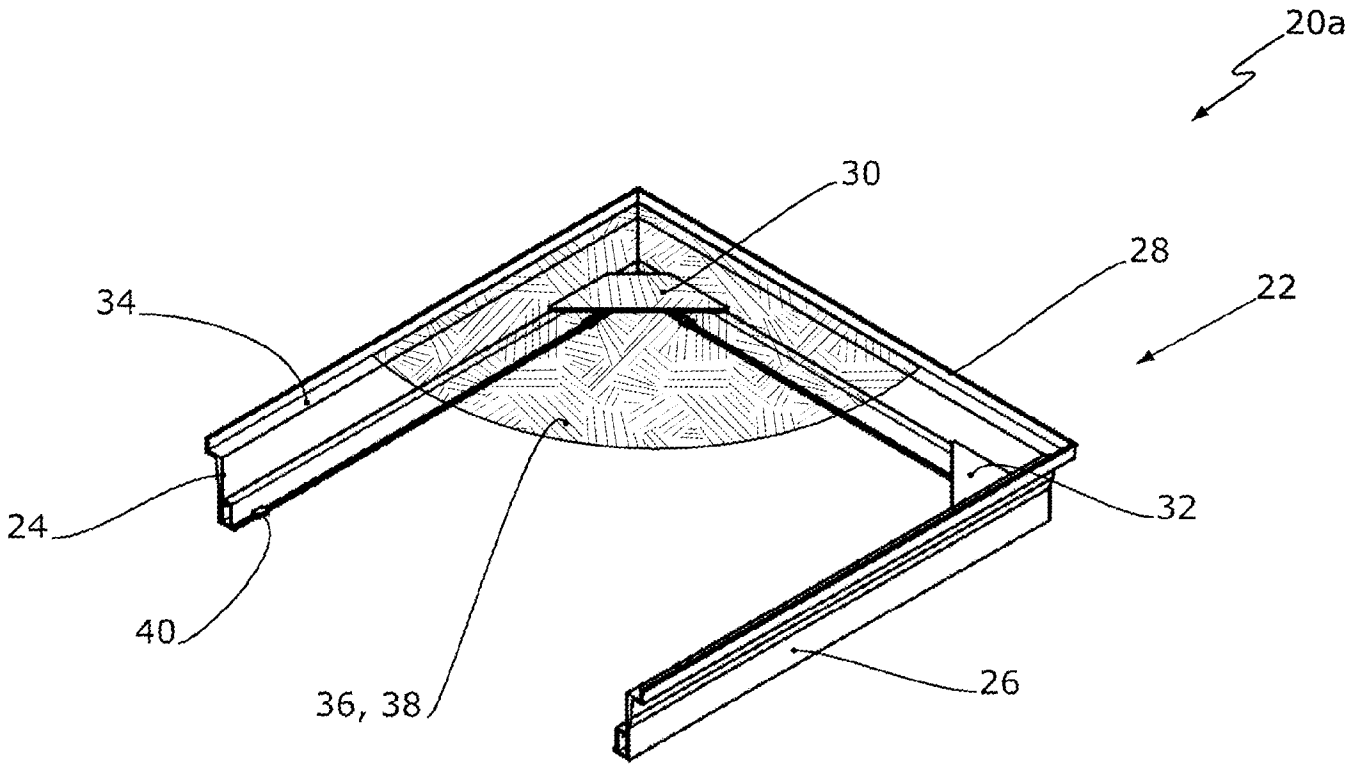
Figure 3:
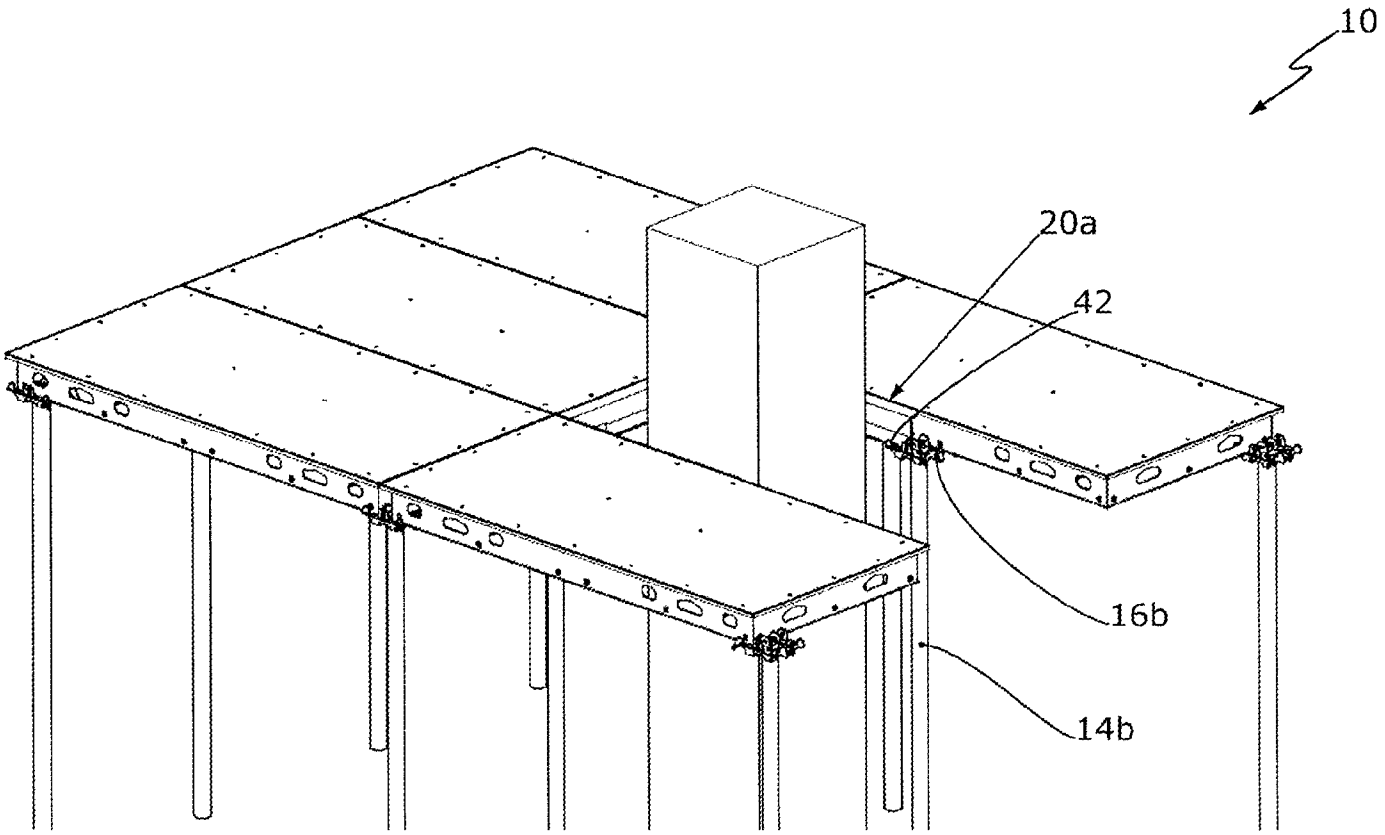
Figure 4:
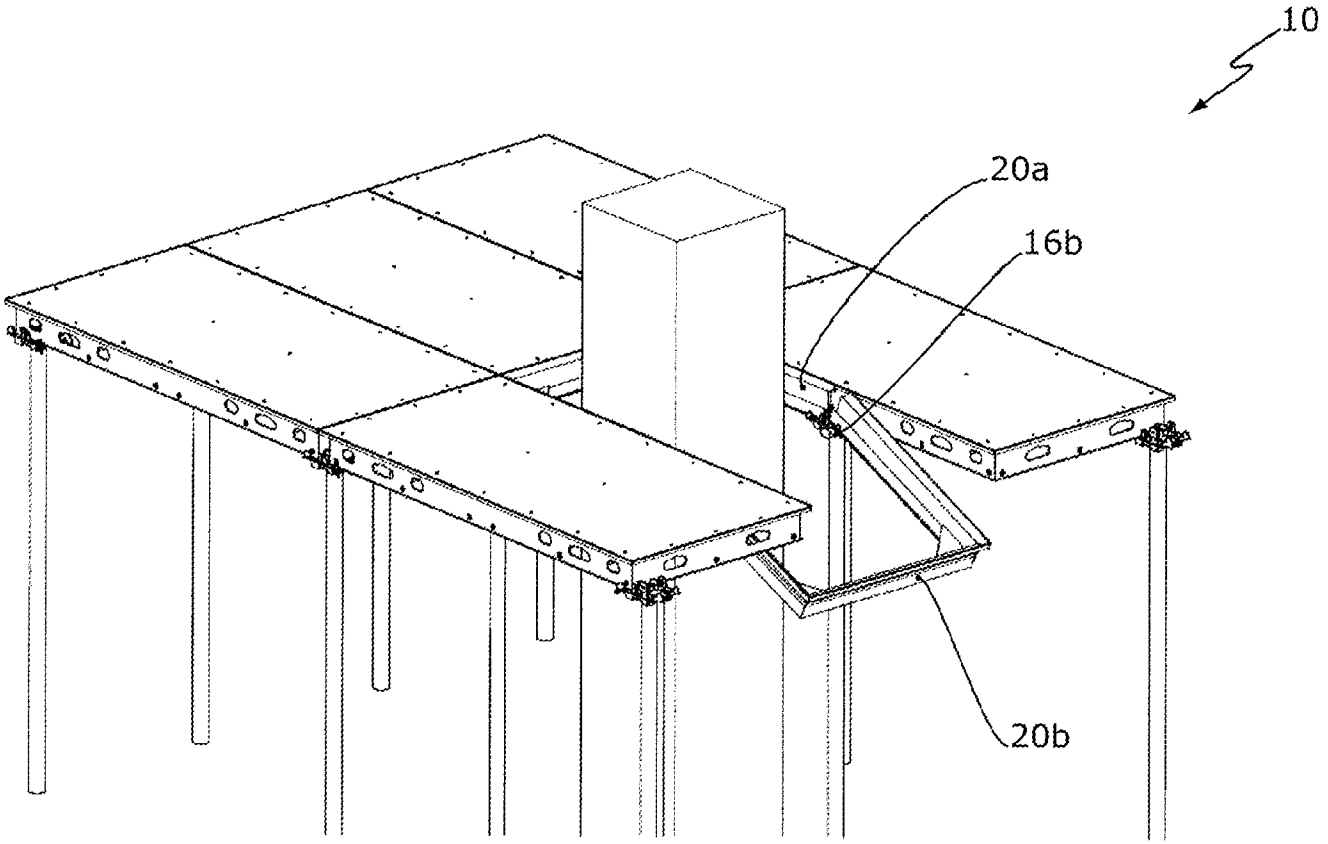
Figure 5:
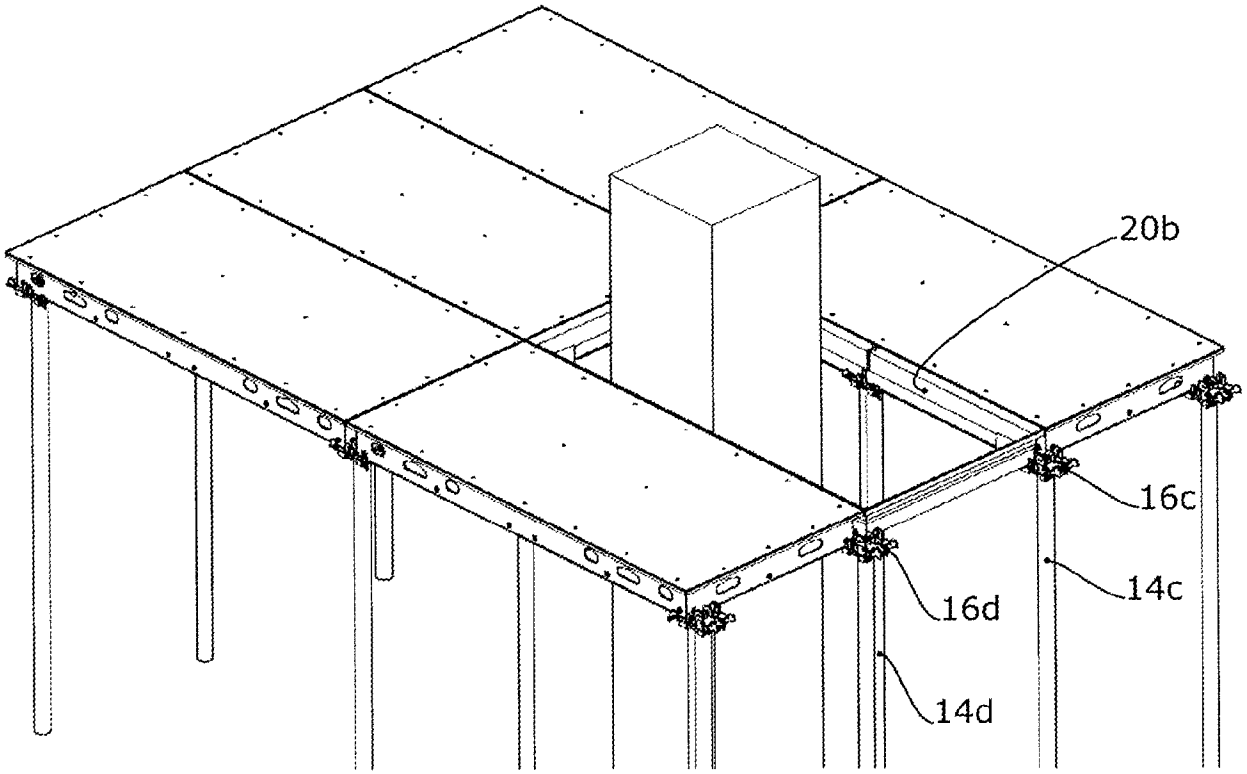
Figure 6:
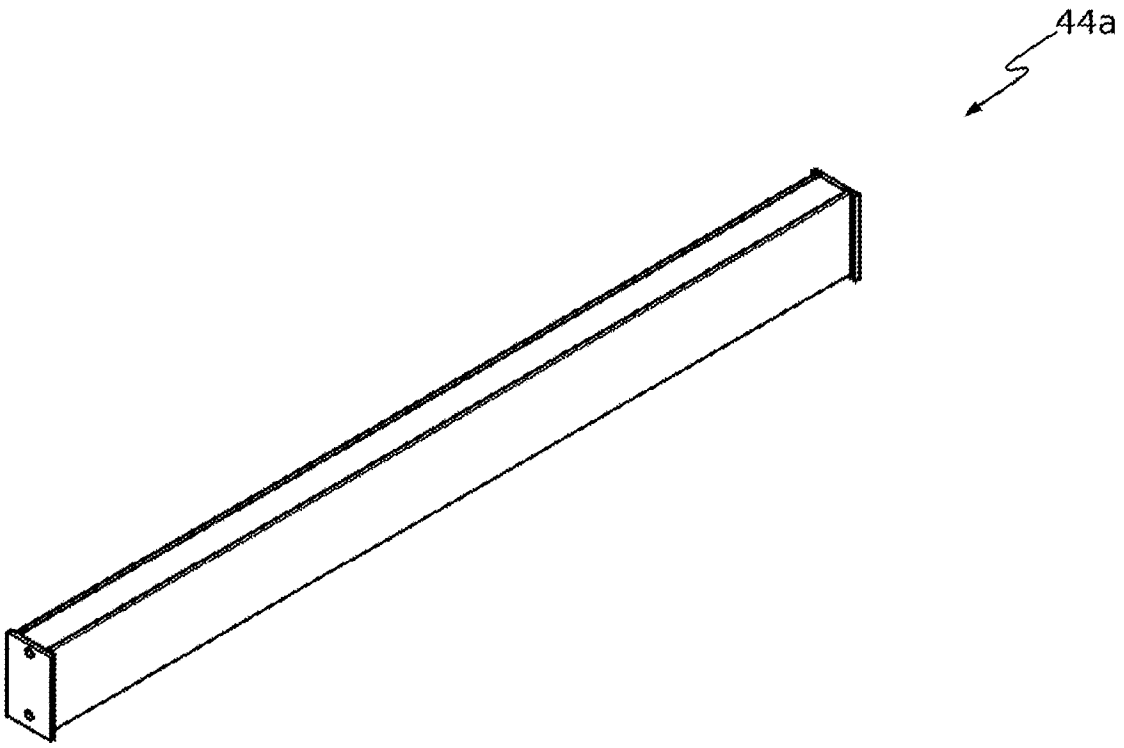

Shown are:

FIG. 1 a perspective view of a ceiling formwork with a plurality of standard formwork elements and a first formwork element for building around an obstacle in the ceiling formwork;

FIG. 2 a perspective view of the formwork element from FIG. 1;

FIG. 3 a perspective view of the ceiling formwork according to FIG. 1 with a fully inserted formwork element;

FIG. 4 a perspective view of the ceiling formwork according to FIG. 3 with an attached second formwork element;

FIG. 5 a perspective view of the ceiling formwork according to FIG. 4 with a fully mounted second formwork element;

FIG. 6 a perspective view of a transverse strut; and

Figure 7:
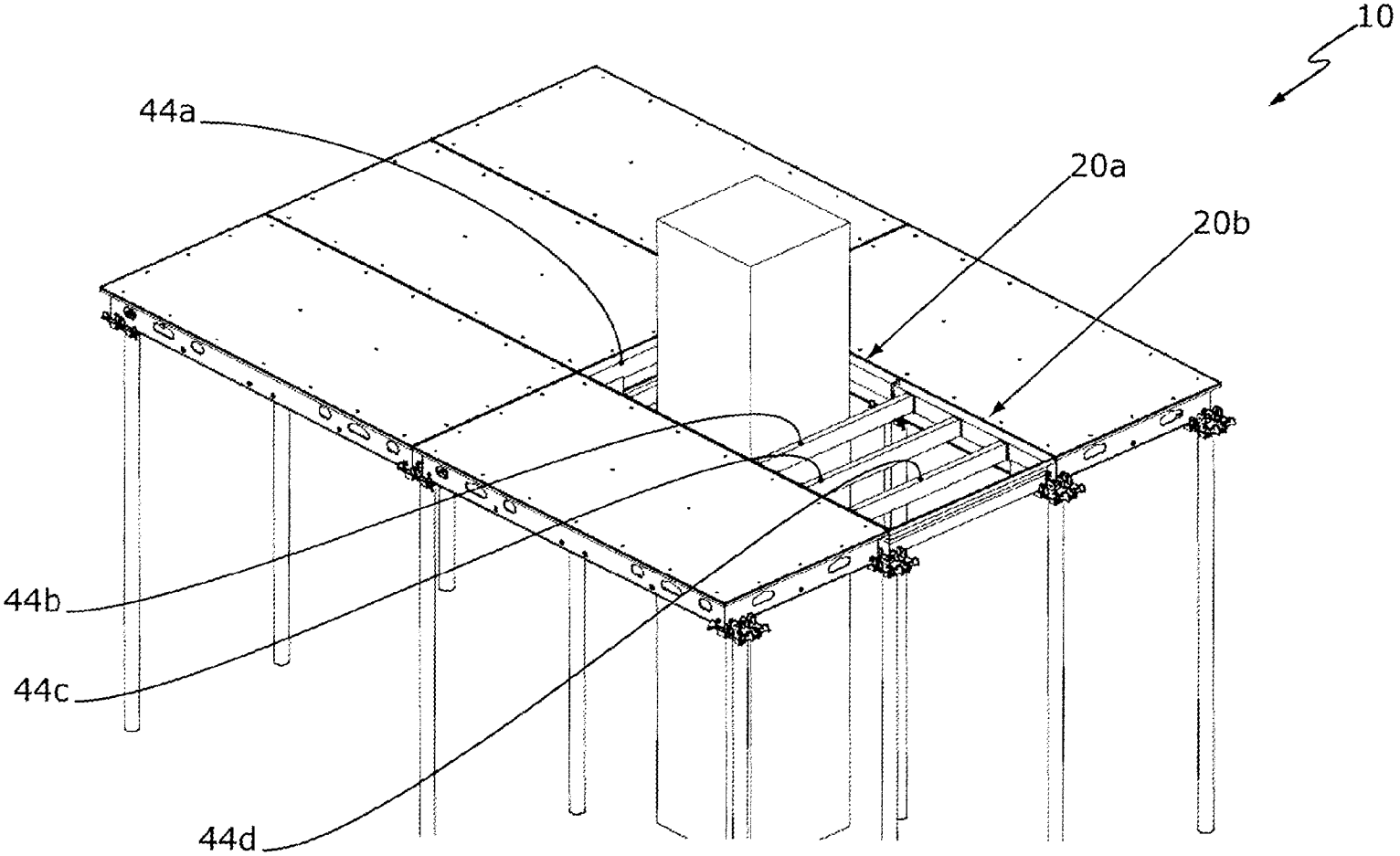

FIG. 7 a perspective view of the ceiling formwork according to FIG. 5 with a plurality of inserted transverse struts according to FIG. 6.

FIG. 1 shows a ceiling formwork 10. The ceiling formwork 10 has a plurality of standard formwork elements 12*a*-12*e* supported on a plurality of pillars, of which only a first pillar 14*a* is provided with a reference character in FIG. 1 in the interests of clarity.

More precisely, the ceiling formwork 10 has a pillar head 16*a* on the upper end of pillar 14*a,* on which the standard formwork elements 12*a*-12*e* can rest, wherein in the case of the pillar head 16*a,* the standard formwork element 12*a* is supported.

As is clear from FIG. 1, the erection of the ceiling formwork 10 is prevented by an obstacle 18, in this case in the form of a column. A formwork element 20*a* that is partly visible in FIG. 1 allows the sealing enclosure or building around of the obstacle 18 in a simple manner according to the invention.

FIG. 2 shows the first formwork element 20*a* alone. The first formwork element 20*a* has a first frame 22 with a U-shaped design. The frame 22 is constructed from a metal profile, in particular in the form of an aluminum profile. The frame 22 has a first leg 24, a second leg 26 and a base strut 28 between the two legs 24, 26. The first leg 24 is connected to the base strut 28 via a first connecting strut 30. The second leg 26 is connected to the base strut 28 via a second connecting strut 32.

The frame 22 has a step 34, on which a formwork skin 36 can be arranged. The formwork skin 36 is represented only partly in FIG. 2 and diagrammed in the interest of clarity. The formwork skin 36 is arranged in a formwork skin layer 38. In the interest of clarity, the formwork skin 36 is not represented in FIG. 7.

To suspend the first formwork element 20*a* in a pillar head (see, for example, FIG. 1: pillar head 16*a*), the frame 22 in the region of each of the end regions of the legs 24, 26 opposite to the base strut 28 has a fastening projection, of which, for the purposes of perspective representation, only a first fastening projection 40 is provided with a reference character in FIG. 2.

FIG. 3 shows the ceiling formwork 10, wherein the first formwork element 20*a,* in contrast to the representation according to FIG. 1, has been fully pivoted from below. The support of the formwork element 20 is accomplished via a pillar head 16*b* that is on a pillar 14*b*. A second fastening projection 42 (see FIG. 2: first fastening projection 40) is incorporated in the pillar head 16*b* in such a way that the first formwork element 20*a* can no longer be moved relative to the pillar head 16*b* perpendicular to the longitudinal axis of the pillar 14*b,* i.e. parallel to the formwork skin layer 38 (see FIG. 2).

FIG. 4 shows the suspension of a second formwork element 20*b* in the pillar head 16*b*. The second formwork element 20*b* has a design identical to the first formwork element 20*a*. The first formwork element 20*a* and the second formwork element 20*b* can be completely mounted from below, whereby the occupational safety during the erection of the ceiling formwork 10 is substantially increased.

FIG. 5 shows the support of the second formwork element 20*b* via pillar heads 16*c*, 16*d*, which are arranged on the pillars 14*c*, 14*d*. The formwork element 20*b* is thus underlain in its two corner regions by the U shape.

FIG. 6 shows a first transverse strut 44*a* for reinforcing the formwork elements 20*a*, 20*b* (see FIG. 7). The first transverse strut 44*a* can preferably be reversibly releasably connected to the frame 22 (see FIG. 2). More preferably, the first transverse strut 44*a* can be screwed to the frame 22 (see FIG. 2). Alternatively or additionally, the first transverse strut 44*a* can be held at least partly positively engaged on the frame 22 by a guide (see FIG. 2).

FIG. 7 shows the ceiling formwork 10 with the formwork elements 20*a*, 20*b*, wherein the formwork elements 20*a*, 20*b* have a plurality of transverse struts 44*a*-44*d*. The transverse struts 44*a*-44*d*, moreover, assist the support of the formwork skin 36 (see FIG. 2), which can be laid directly on longitudinal sides of the transverse struts 44*a*-44*d*. The transverse struts 44*a*-44*d* are ideally mounted before the mounting of the formwork element 20*b*.

When viewing all figures of the drawing together, the invention relates collectively to a formwork element 20*a*, 20*b* of a ceiling formwork 10. The formwork element 20*a*, 20*b* has a non-fully circumferentially closed, in particular U-shaped, frame 22 onto which a formwork skin 36 can be or is arranged. The frame 22 preferably has at least a first leg 24, a second leg 26 and a base strut 28 in between. The base strut 28 is preferably oriented at a right angle ±5° relative to the two legs 24, 26. The legs 24, 26 are preferably each provided at their end regions opposite to the base strut 28 with a fastening projection 40, 42 and/or a fastening recess. The formwork element 20*a*, 20*b* can be suspended into a pillar head 16*a*-16 by a worker from below and can be pivoted upward. It makes it possible to build around an obstacle 18 in a simple manner while maintaining a grid-like imprint structure in the concrete surface to be created with the ceiling formwork 10.

The invention claimed is:

1. A method for erecting a ceiling formwork having a plurality of pillars, comprising:

erection of a first pillar having a first pillar head and a second pillar having a second pillar head;

laying of a first formwork element in a region of a base strut of a frame onto the first pillar head and the second pillar head;

erection of a third pillar having a third pillar head and underlaying of a first leg of the frame;

erection of a fourth pillar with a fourth pillar head and underlaying of a second leg of the frame;

underlaying of a second formwork element, wherein a first leg of the frame of the second formwork element is laid on the fourth pillar head and a second leg of the frame of the second formwork element is laid on the third pillar head; and erection of a fifth pillar having a fifth pillar head and a sixth pillar having a sixth pillar head, wherein the fifth pillar head and the sixth pillar head underlie the second formwork element in the region of a base strut of the frame of the second formwork element.

2. The method according to claim 1 further comprising:

G) arrangement of a formwork skin from above on the first formwork element and/or the second formwork element from above.

3. A formwork system, comprising:

a ceiling formwork having a plurality of formwork elements each having legs that define a closed frame;

a compensating formwork element, comprising:

a frame configured to support a formwork skin in a formwork skin layer, wherein the frame is not fully closed on at least one side;

a first connecting strut on a first leg of the frame connected to a base strut; and a second connecting strut on a second leg of the frame connected to the base strut, wherein the first leg and the second leg are half as long as legs of one of the plurality of formwork elements or the first leg and the second leg are of equal length to the legs of one of the plurality of formwork elements.

4. The formwork system according to claim 3, wherein the frame has a U-shaped design configured to be parallel to the formwork skin layer.

5. The formwork system according to claim 3, further comprising:

a first fastening recess and/or a first fastening projection on the first leg of the frame;

and/or a second fastening recess and/or a second fastening projection on the second leg of the frame.

6. The formwork system according to claim 3, in which the formwork element has a first transverse strut between the first leg of the frame and the second leg of the frame, wherein the two legs run parallel to each other within ±5°.

7. The formwork system according to claim 6, in which the formwork element has a plurality of transverse struts between the first leg of the frame and the second leg of the frame.

8. The formwork system according to claim 3, in which the frame has a step for receiving the formwork skin.

9. The formwork system according to claim 3, in which the frame is formed by a metal profile.

10. The formwork system according to claim 9, in which the metal profile is designed in the form of an aluminum profile.

11. The formwork system according to claim 3, in which the formwork element has a formwork skin that is arranged on the frame.

12. The formwork system of claim 3, further comprising:

a second compensating formwork element, comprising:

a second frame configured to support a formwork skin in a formwork skin layer, wherein the frame is not fully closed on at least one side;

a third connecting strut on a third leg of the second frame connected to a base strut; and a fourth connecting strut on a fourth leg of the second frame connected to the base strut such that the third connecting strut and the fourth connecting strut allow for stiffening of the second frame without limiting leeway for the second frame to receive an obstacle, wherein the third leg and the fourth leg are half as long as legs of one of the plurality of formwork elements.

13. The formwork system of claim 3, wherein the first connecting strut and the second connecting strut allow for stiffening of the frame without limiting leeway for the frame to receive an obstacle.

14. A formwork system, comprising:

a ceiling formwork having a plurality of formwork elements each having legs that define a closed frame;

a compensating formwork element, comprising:

a frame configured to support a formwork skin in a formwork skin layer, wherein the frame is not fully closed on at least one side;

a first connecting strut on a first leg of the frame connected to a base strut; and a second connecting strut on a second leg of the frame connected to the base strut, wherein the first leg and the second leg are half as long as legs of one of the plurality of formwork elements.

15. The formwork system of claim 14, wherein the first connecting strut and the second connecting strut allow for stiffening of the frame without limiting leeway for the frame to receive an obstacle.

* * * * *